United States Patent [19]

Monjo

[11] 4,009,553

[45] Mar. 1, 1977

[54] MACHINE FOR FILLING POCKETS

[76] Inventor: Jacques Yves Monjo, "Gueyrosse", 33350 Ste-Terre, France

[22] Filed: Feb. 7, 1975

[21] Appl. No.: 547,976

[30] Foreign Application Priority Data

Feb. 7, 1974 France ..... 74.04751

[52] U.S. Cl. ..... 53/160; 53/246

[51] Int. Cl.[2] ..... B65B 5/08; B65B 5/10; B65B 35/30

[58] Field of Search ..... 53/154, 160, 166, 237, 53/246, 251, 260; 198/22 R, 30

[56] References Cited

UNITED STATES PATENTS

| | | | |
|---|---|---|---|
| 2,834,169 | 5/1958 | Stuart | 53/246 |
| 2,847,809 | 8/1958 | Lindemann et al. | 53/246 X |
| 2,968,899 | 1/1961 | Holmes | 53/246 X |
| 3,623,592 | 11/1971 | Anderson | 198/30 |

FOREIGN PATENTS OR APPLICATIONS

| | | | |
|---|---|---|---|
| 1,290,477 | 3/1969 | Germany | 53/246 |

*Primary Examiner*—Robert Louis Spruill
*Attorney, Agent, or Firm*—Brisebois & Kruger

[57] ABSTRACT

Machine for filling pockets comprises an upper conveyor for carrying incoming articles and a lower conveyor passing beneath the output end of the upper conveyor. A row of dispensing means is provided at the output end of the upper conveyor for dropping articles into the pockets of trays carried by the lower conveyor and means are provided for reciprocating the dispensing means transversely of the conveyors to allow for staggering of the pockets. One of the dispensing means may be closed every time the row of dispensing means moves in one direction.

8 Claims, 9 Drawing Figures

22
21
20
24
19
27
6
42
9
8
13
41
18
42
17
3
25
25a
5
1
16
7
44
2
43
7
44

41
42
27
30
28
6
18
17
44
16
44
43
7
2
31
1
26
3
21
9
34
32
5
33
8

MACHINE FOR FILLING POCKETS

SUMMARY OF THE INVENTION

This invention relates to an automatic machine for filling the pockets of trays with fruit or other merchandise, when these pockets are positioned in rows with the pockets in each row staggered with respect to the pockets of the adjacent rows. This is accomplished by using a series of pairs of jaws which are positioned at the end of an input conveyor for the fruit and movable transversely thereof. These jaws empty the fruit which they contain row by row into the corresponding pockets in trays positioned on a second conveyor located below the input conveyor and carrying said trays from a filling station to a packaging and/or storing station.

Various machines for filling the pockets of trays or boxes with fruit or othe merchandise are already known, especially the one described in U.S. Pat. No. 2,834,169 in which the fruit carried by a conveyor belt is brought into alignment with pockets to be filled by means of transversely movable guides on rotating control means which serves to align a row of fruit corresponding to the number of pockets in a row of pockets and then empty the fruit into these pockets during a rotation which is controlled in synchronism with the advance of the tray. During the emptying process the fruit in the guides is held by means of the rotating control device so as to permit the transverse displacement of the guide and the fruit so that they are positioned in alignment with the pockets in the next row to be filled.

This machine has the disadvantage that it may be used only to fill trays having the same number of pockets in each row, with the pockets in each row staggered relative to those in adjacent rows, so that its use is limited to handling articles of a single size. It is therefore unsuitable for those trays currently in use which comprise a varying number of pockets per row depending upon the size of the fruit.

It is consequently an object of the invention to provide an automatic machine for filling the pockets in storage trays with fruit, when the rows of said pockets are staggered with respect to each other and the number of pockets per row is not always the same. This is accomplished by means of transversely movable pairs of jaws positioned at the end of an input conveyor belt. The alternating transverse movement of these pairs of jaws makes it possible, after the advance of the tray, to successively empty the fruit row by row into the corresponding pockets of the tray.

The operation of the invention will appear from the following description, with reference to the attached drawings in which.

Figure 1:
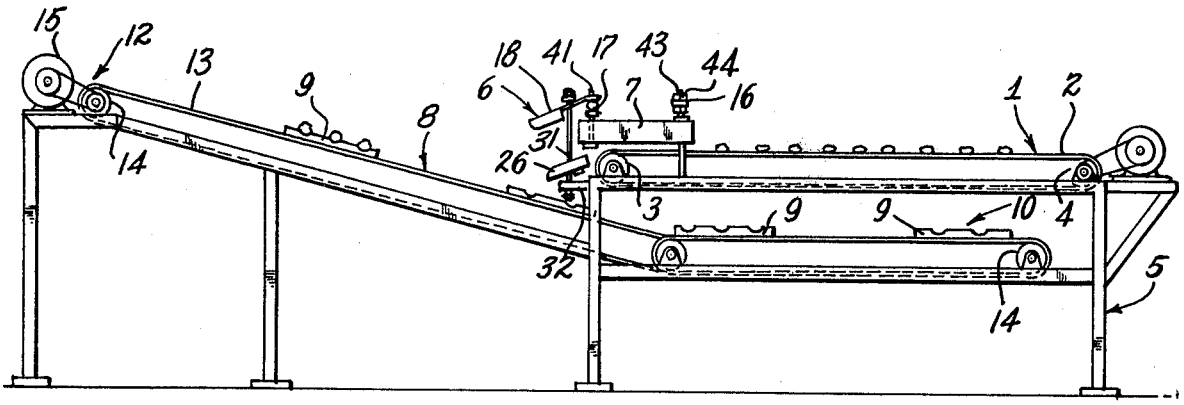
FIG. 1 is a schematic side view of the machine.

As shown on FIG. 1, the machine comprises an input conveyor 1 comprising an endless conveyor belt 2, made of rubber or any other suitable material, which extends and travels between a movable drum 3 and a driving drum 4 which are mounted on a supporting framework 5. The fruit or other merchandise carried by the conveyor belt 2 is received at the end of the belt 1 by a series of transversely movable pairs of jaws 6, the fruit being directed toward the jaws 6 by movable separating guide means 7. Beneath the conveyor 1 is a conveyor 8 for pocketed trays 9, the height of which conveyor is adjustable by conventional means. Trays 9 are brought from a locating station 10 toward a packaging and/or storage station 12 by means of chains 13 or an endless belt traveling between two or more series of pinions or drums 14, one of which is driven by a motor 15. The drum 4 may be driven by the same motor or, as shown, by a separate motor, so long as the two conveyors advance in synchronism.

The trays 9 are filled with fruit or any other merchandise as they pass beneath the jaws 6.

Figure 2:
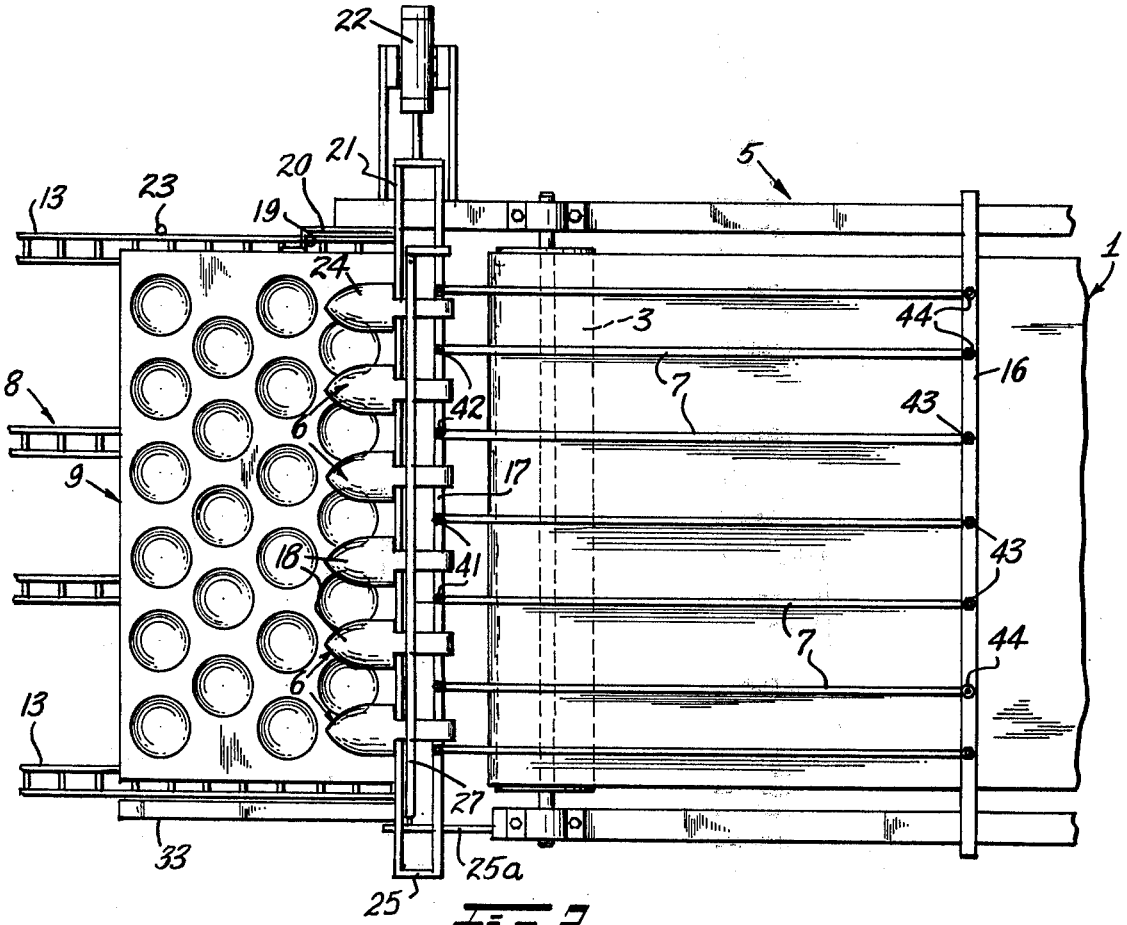
FIG. 2 is a top plan view taken from a point immediately above the series of pairs of jaws.
Figure 3:
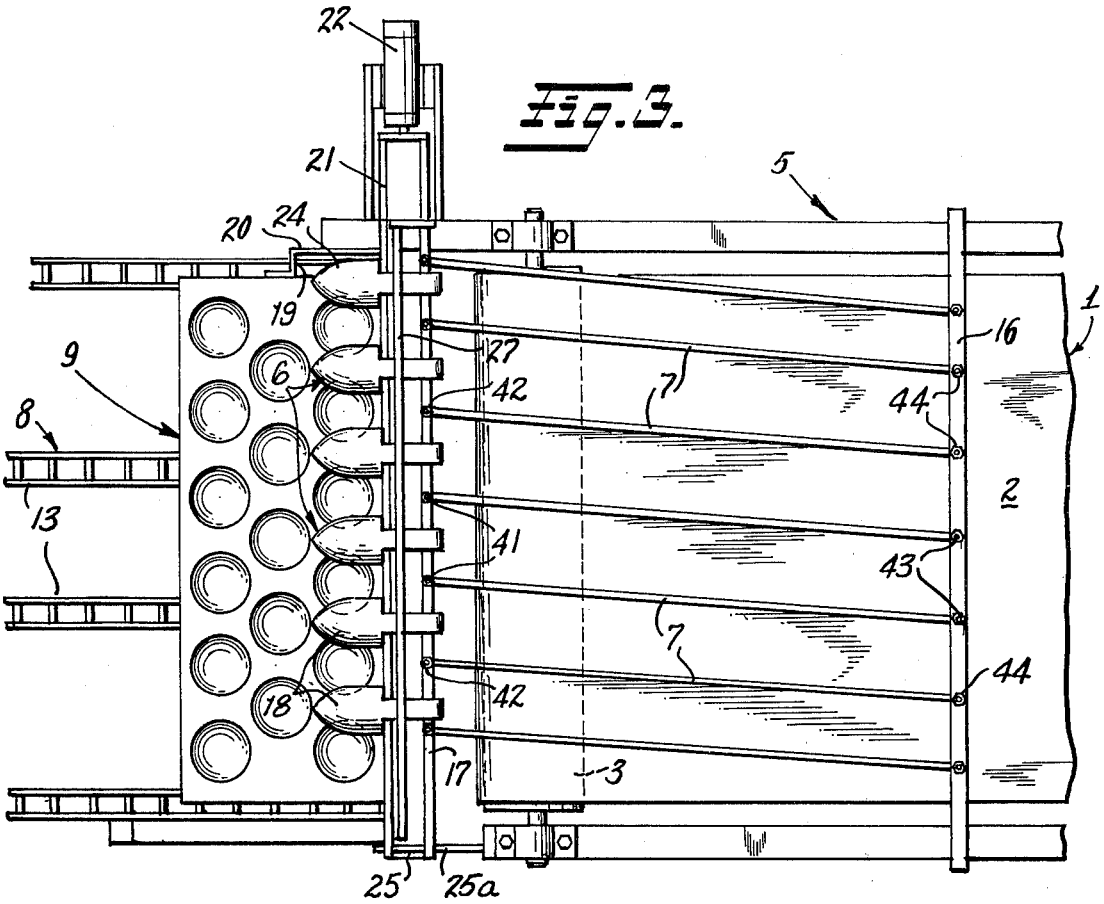
FIG. 3 is a top plan view taken from the same position as FIG. 2 with the jaws shifted transversely.
Figure 4:
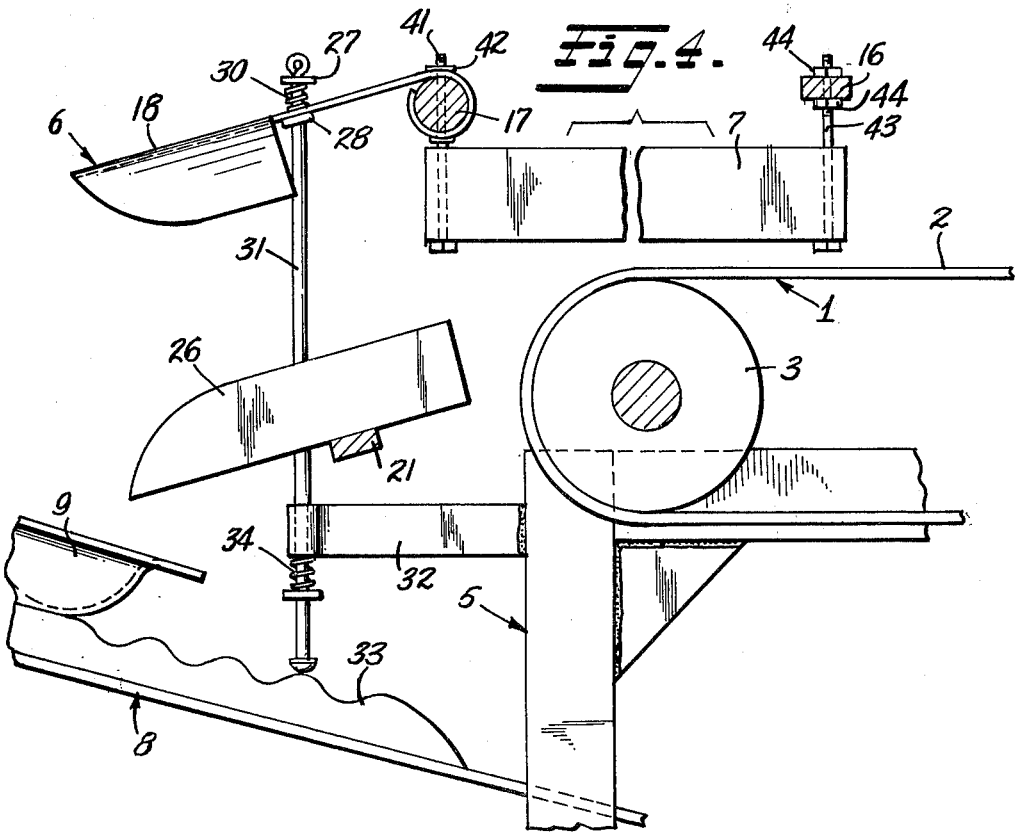
FIG. 4 is a detail view taken from one side showing the jaws and their separator guide as well as the control means for opening and closing the jaws by means of a connecting rod.

As shown in FIGS. 2, 3 and 4 a row of pairs of jaws 6 carried by the rods 28 and 21 at the end of the conveyor 1 is reciprocated transversely, together with one end of the separating guides 7, by a fluid pressure jack 22, so that the jaws 6 empty the fruit or other merchandise successively and row by row into the corresponding pockets which are staggered from one row to the next in the tray 9, as the tray 9 advances.

The separating guides 7 are mounted to pivot, on the one hand, with respect to a stationary transverse member 16 positioned on the supporting frame 5 and, on the other hand, with respect to the movable shaft 17 reciprocated by the jack 22, and on which the upper members 18 of the jaws 6 are pivotally supported, so that the fruit or other merchandise may always be directed toward the jaws 6 during their alternating transverse displacement.

In view of the fact that the trays 9 do not always have the same number of pockets per row, due to differences in the size of the fruit or other merchandise, means for compensating for this difference are carried on the frame 5 in the form of a movable or stationary plate 20 defining a recess 19 adapted to receive the end jaw 24 (as best seen in FIG. 3) and permit the retention of fruit which is in excess at the moment when the row of jaws 6 is at an extreme transverse position relative to a row of pockets comprising one pocket less than the number of jaws. The transverse movement of the row of jaws 6 produced by the jack 22 is synchronized with the advance of the tray 9, and the fruit is emptied, by means of stops 23 which are previously mounted on one of the chains 13 of the conveyor 8, or on the belt, in alignment with the trays and which initiate the action of the jack 22 by means of electrical contacts (not shown). The transverse displacement of the row of jaws 6 and the advance of the tray 9 takes place only when the row of jaws is filled with fruit or other merchandise as determined by electrical contacts (not shown) mounted on each jaw 6.

The transverse displacement of the series of jaws 6 is limited and defined in dependence upon the size of the fruit and the tray by means of a stop 25 which connects the movable shaft 17, which supports the upper members 18 of the jaws 6, and the lower movable transverse member 21 which supports the lower stationary members 26 of the jaws. The stop 25 depends from the shaft 17 and movable member 21 and strikes the abutment 25*a* when the shaft and movable member are moved from the position shown in FIG. 2 to the position shown in FIG. 3. The adjustability of the stop 25 also makes it possible to utilize the series of jaws 6 for several different sizes of fruit, or merchandise, or trays 9. Depending upon the size of the fruit or merchandise, and that of the corresponding trays 9, the number of jaws 6 corresponds to the largest number of pockets in a row of the trays 9, and the spacing between each pair of jaws 6 corresponds to the spacing between the pockets so that they are properly positioned on the shaft 17 and the transverse member 21, on which they are adjustable with respect to each other by means of adjusting screws or stops distributed and slidable on the shaft 17 and transverse member 21. Assemblies comprising the jaws 6, transverse member 21, shaft 17, and separating guides 7, are interchangeable and these interchangeable assemblies are adapted to correspond to the size of fruit or merchandise to be located in the pockets of the trays corresponding to said size.

The jaws 6, in the embodiment illustrated in FIGS. 4, 5, 6, and 7, consist of a lower member 26 fixed on a movable transverse member 21, and an upper member 18 mounted in the shaft 17. The jaws 6 are opened and closed by a transverse member 27 which is vertically movable and connected to the upper jaws 18 by means of arms 28 which are fixed to the upper jaws 18 by bolts 29 carrying the compensating springs 30 which absorb the irregularities in the size of the fruit or other merchandise. The transverse member 27 is controlled by the connecting rod 31 which is slidable in a guide 32 fixed to the supporting frame 5. The connecting rod 31 is actuated by the passage of the cam 33 fixed to the chain or conveyor belt 8 in alignment with and parallel to the trays 9. When the cam 33 escapes from the connecting rod 31 after each tray has been filled, the latter is pushed downward by means of a spring 34 which lowers the transverse member 27 and thus draws down the upper jaws 18. On the shaft 17, between the pairs of jaws, the pins 41 supporting separating guides 7 are held in bores in said shaft by means of nuts 42, the other ends of said guides being held by and pivotally mounted on pins 43 held in place by nuts 44 on the transverse member 16.

The cam 33 extends for the length of a tray 9, or its width, depending upon the direction of change desired, and may be uniform in height. The release of fruit or merchandise takes place continuously for a tray 9 when a counter or electrical contact is placed on each separating guide, so as to insure that the fruit or merchandise is sufficient in number to fill a tray. The filling and advance of a tray does not take place until this condition is fulfilled.

In another embodiment (not illustrated) the cam 33 may be provided with notches arranged between each row of pockets in order to close the jaws between each row of pockets. It is also possible to replace the connecting rod 31 by a fluid pressure jack, its action being then controlled by electrical contacts or stops mounted on the chain 13, or conveyor belt 8, in alignment with the trays 9 opposite or between the rows of pockets.

Figure 5:
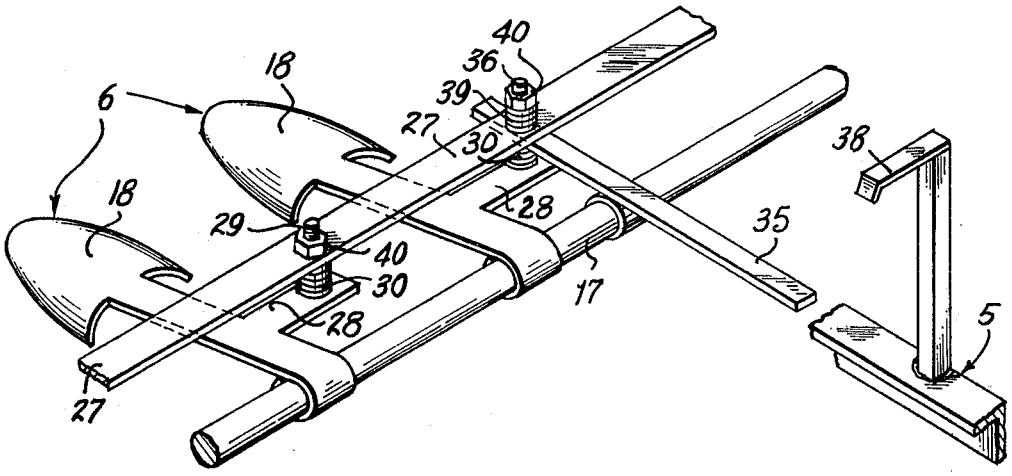
FIG. 5 shows an end pair of jaws blocked by a finger.
Figure 6:
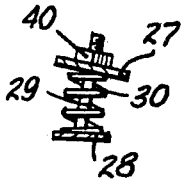
FIG. 6 shows the details of the connection between the jaws and is taken through the closure means.
Figure 7:
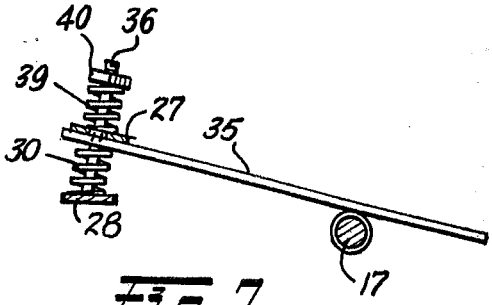
FIG. 7 shows details of the connection and closing means for the end jaw.
Figure 8:
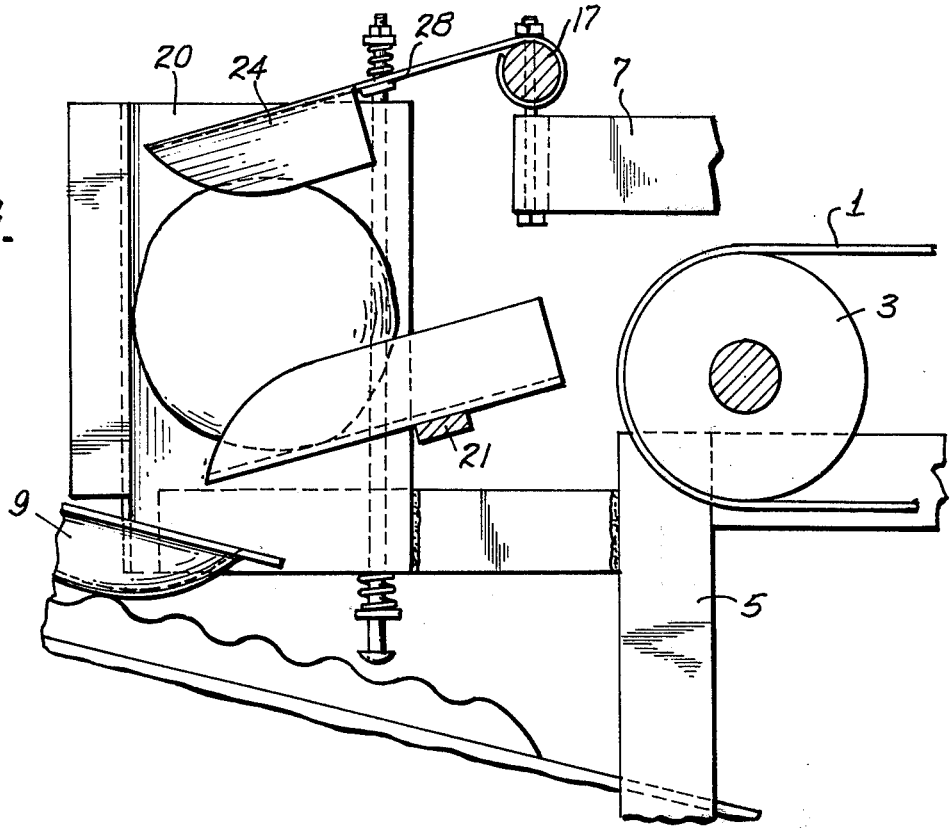
FIG. 8 is a partial schematic vertical sectional view showing an article to be handled in the blocked position.
Figure 9:
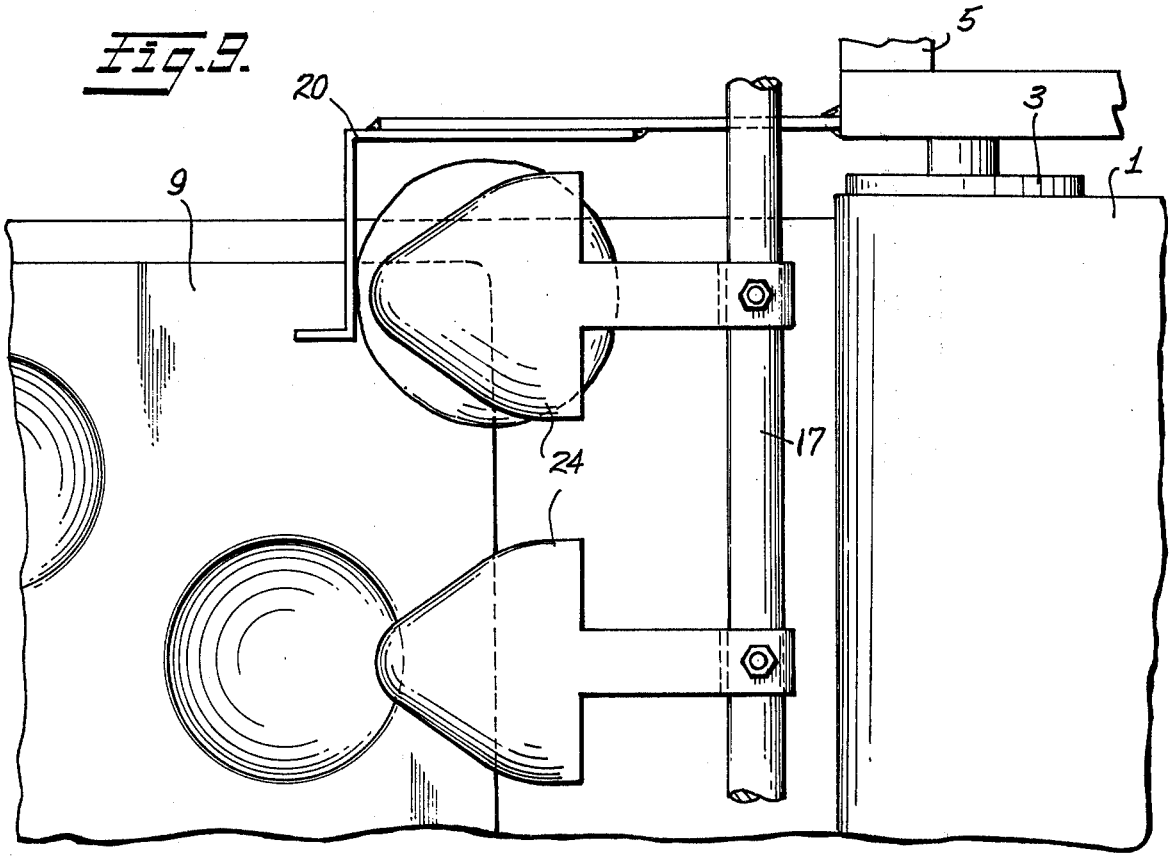
FIG. 9 is a top plan view of the apparatus shown in FIG. 8.

An alternative embodiment shown on FIG. 5 in which the end jaw 24 is closed when it is received in the recess 19 so that it does not handle fruit or merchandise, the machine comprises a second arm 35 pivoted about the shaft 17, said arm 35 being mounted at one end on the bolt 36 between the transverse member 27 and the spring 30 while its other end is positioned to be raised by the finger 38 on the frame 5 during the displacement of the jaws 6 by means of the jack 22. This leads at the other end of the arm 35 to the lowering of the endmost upper jaw in the absence of movement by the transverse member 27 due to the presence of the spring 39 (FIG. 7) positioned between the transverse member 27 and the nut 40 on the bolt 36, which sides in the hole provided for this purpose on the transverse member 27.

On the other hand the conveyor belt 8 is adjustable in height in order to perfectly empty the fruit or merchandise, which must not be bruised or spoiled, because in dependence upon its size, the trays 9 are taller or shorter. It is also possible to compensate for this difference in height resulting from the sizes by having the jaws longer or shorter. In order to fill trays 9 provided with an identical number of pockets per row, the series of jaws 6 is shifted so that, in its extreme position, the jaw 24 is not seated in the recess 19 and the closure finger 38 may then be eliminated. In accordance with other embodiments (not illustrated) the machine may serve to fill all sorts of trays, whether provided with pockets or not, and whether the rows are staggered with respect to each other or not, and in this case comprise the same number of pockets per row. In this case the row of pairs of jaws 6 is not transversely movable and it is also possible to fill one or more trays, depending on their width or length, simultaneously, and especially if the latter may be included within the width of the conveyor 8.

A particularly useful embodiment consists in providing a row of interchangeable pairs of jaws which are fixed transversely so as to fill the pocketed trays, which are positioned in a staggered arrangement, and move the lower conveyor 8 transversely by means of jacks or any other suitable members such as racks and pinons which are actuated pneumatically or by an electric motor, regardless of whether the rows of pockets in the trays contain the same number of pockets or a different number of pockets, in view of the fact that in the case of trays in which the number of pockets per row is not the same the jaw 24 is closed by the finger 38 which is then fixed to the framework of the conveyor 8.

The machine according to the invention may be used to load, locate and distribute vegetables and all sorts of objects and merchandise of a generally rounded type onto trays provided with pockets arranged in consecutive rows with the number of pockets per row the same or different, and the pockets of consecutive rows being aligned or staggered. The machine may also be used to fill one or more flat trays, depending on whether their width or length permits them to be supported and aligned on the lower conveyor beneath the row of pairs of filling jaws.

I claim:

1. In an automatic machine for filling pocketed trays with articles, said machine comprising an upper conveyor mounted on a framework to travel between an input point and an output point, a row of dispensers extending transversely of said conveyor at said output point, separating guides mounted on said framework longitudinally of and above said conveyor for directing said articles into columns extending longitudinally of said upper conveyor, with each column leading to a different dispenser, a lower conveyor positioned to advance trays toward a filling position just beyond and beneath said output end of said upper conveyor in a direction substantially parallel to the path of travel of said upper conveyor, means for advancing said conveyors in synchronism, said dispensers being adapted to open and close, and to permit an article held thereby to fall onto a tray in said filling position when open, and means for opening and closing said dispensers, the improvement which comprises:

means for causing relative movement between said row of dispensers and lower conveyor in a direction transverse to said lower conveyor in synchronism with the movement of said lower conveyor, and means in alignment with said row of dispensers for blocking only an endmost dispenser each time a selected relationship between said row of dispensers and lower conveyor resulting from said relative movement is attained while allowing other dispensers of said row to operate.

2. Machine as claimed in claim 1 in which said dispensers are pairs of jaws, at least one jaw of each pair being pivotally mounted.

3. Machine as claimed in claim 2 wherein said means for opening and closing said dispensers comprises a cam on said lower conveyor, a transverse bar connected to one jaw of each pair and a follower connected to said bar and contacting said cam so as to actuate said bar in dependence on the contour of said cam.

4. Machine as claimed in claim 3 in which said cam is formed with notches which permit closing of said jaws.

5. Machine as claimed in claim 1 in which said blocking comprises means defining means a recess receiving said endmost dispenser.

6. Machine as claimed in claim 1 in which said means for causing relative movement between said dispensers and said lower conveyor comprises a hydraulic jack.

7. Machine as claimed in claim 1 in which said row of dispensers is moved without transverse movement of said lower conveyor.

8. Machine as claimed in claim 7 in which the ends of said guides nearest the output point of said upper conveyor are mounted to move transversely of said conveyor with said dispensers.

* * * * *